US010261452B2

(12) United States Patent
Hashimoto

(10) Patent No.: US 10,261,452 B2
(45) Date of Patent: Apr. 16, 2019

(54) IMAGE PROCESSING APPARATUS HAVING IMAGE HEATING PORTIONS THAT CAN PERFORM DECOLORING PROCESSING INDEPENDENTLY

(71) Applicants: KABUSHIKI KAISHA TOSHIBA, Tokyo (JP); TOSHIBA TEC KABUSHIKI KAISHA, Tokyo (JP)

(72) Inventor: Yoshihisa Hashimoto, Gotenba Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/025,782

(22) Filed: Jul. 2, 2018

(65) Prior Publication Data

US 2018/0314194 A1 Nov. 1, 2018

Related U.S. Application Data

(63) Continuation of application No. 15/392,544, filed on Dec. 28, 2016, now Pat. No. 10,018,945.

(51) Int. Cl.

| | |
|---|---|
| ***G03G 15/20*** | (2006.01) |
| ***G03G 15/00*** | (2006.01) |
| ***G03G 21/00*** | (2006.01) |

(52) U.S. Cl.

CPC ..... *G03G 15/205* (2013.01); *G03G 15/00* (2013.01); *G03G 15/20* (2013.01); *G03G 15/6582* (2013.01); *G03G 21/00* (2013.01); *G03G 15/502* (2013.01); *G03G 15/6585* (2013.01)

(58) Field of Classification Search

CPC ..... G03G 15/205; G03G 15/20; G03G 15/00; G03G 15/6582; G03G 15/502; G03G 15/6585; G03G 21/00

See application file for complete search history.

(56) References Cited

U.S. PATENT DOCUMENTS

| | | | | |
|---|---|---|---|---|
| 7,024,152 | B2 * | 4/2006 | Lofthus | G03G 15/238 399/365 |
| 2007/0297015 | A1 * | 12/2007 | Kinouchi | H04N 1/29 358/300 |
| 2008/0181639 | A1 | 7/2008 | Yokomizo | |
| 2010/0272449 | A1 | 10/2010 | Yoshida et al. | |

(Continued)

FOREIGN PATENT DOCUMENTS

| | | | |
|---|---|---|---|
| JP | 2015069185 | A | 4/2015 |

*Primary Examiner* — G. M. A Hyder
(74) *Attorney, Agent, or Firm* — Kim & Stewart LLP

(57) ABSTRACT

An image processing apparatus for decoloring a decolorable toner image formed on one or more sheets, includes an image processing unit comprising a controller and an image heating section, wherein the image heating section is selectively operable at a toner fixing temperature and an image decoloring temperature that is higher than the toner fixing temperature, a communication interface configured to communicate with an external decoloring device, and a user input section. The controller, upon receiving a request to decolor one or more sheets that is made through the user input section, determines which of the image heating section and the external decoloring device will be the first available to decolor the one or more sheets.

10 Claims, 12 Drawing Sheets

(56) References Cited

U.S. PATENT DOCUMENTS

| | | | | |
|---|---|---|---|---|
| 2012/0141154 | A1* | 6/2012 | Yoshida | G03G 15/6585 399/69 |
| 2012/0141175 | A1 | 6/2012 | Fujiwara et al. | |
| 2012/0288290 | A1 | 11/2012 | Hano et al. | |
| 2012/0315591 | A1 | 12/2012 | Tsuchihashi et al. | |
| 2013/0002783 | A1* | 1/2013 | Mizutani | B41J 2/32 347/179 |
| 2013/0016376 | A1* | 1/2013 | Hashidume | G03G 21/00 358/1.9 |
| 2013/0242024 | A1 | 9/2013 | Iguchi | |
| 2014/0192374 | A1 | 7/2014 | Shinohara | |
| 2014/0212160 | A1 | 7/2014 | Fukaya | |
| 2015/0063847 | A1 | 3/2015 | Yokomizo | |
| 2015/0253709 | A1 | 9/2015 | Fukaya | |
| 2015/0370512 | A1 | 12/2015 | Yamaguchi | |
| 2016/0103644 | A1* | 4/2016 | Saito | H04N 1/00411 358/1.15 |
| 2016/0229212 | A1* | 8/2016 | Yokoyama | G03G 15/01 |
| 2017/0068191 | A1 | 3/2017 | Ueno | |

* cited by examiner

FIG. 8

49

| JOB NUMBER | JOB TYPE | DATE AND TIME OF GENERATION OF JOB | DATE AND TIME OF COMPLETION OF JOB | THE NUMBER OF SHEETS PROCESSED |
|---|---|---|---|---|
| | ... | ... | ... | ... |
| 1 | PRINTING JOB | Sep.1.2016/10:00 | Sep.1.2016/10:02 | 10 |
| 2 | DECOLORING JOB | Sep.3.2016/14:00 | Sep.3.2016/15:01 | 1 |
| 3 | FAX TRANSMISSION JOB | Sep.10.2016/15:00 | Sep.10.2016/15:02 | 3 |
| 4 | COPYING JOB | Sep.11.2016/16:00 | Sep.11.2016/16:05 | 23 |
| 5 | PRINTING JOB | Sep.25.2016/09:00 | Sep.25.2016/9:01 | 1 |
| 6 | DECOLORING JOB | Sep.25.2016/12:00 | NOT YET COMPETED | 2 |
| 7 | PRINTING JOB | Sep.25.2016/13:00 | NOT YET COMPLETED | 1 |
| 8 | PRINTING JOB | Sep.25.2016/14:00 | NOT YET COMPLETED | 1 |
| | ... | ... | ... | ... |

IMAGE PROCESSING APPARATUS HAVING IMAGE HEATING PORTIONS THAT CAN PERFORM DECOLORING PROCESSING INDEPENDENTLY

CROSS-REFERENCE TO RELATED APPLICATION

This application is a continuation of U.S. patent application Ser. No. 15/392,544, filed on Dec. 28, 2016, the entire contents of which are incorporated herein by reference.

TECHNICAL FIELD

Embodiments described herein relate generally to an image processing apparatus.

BACKGROUND

A decoloring apparatus that decolors an image that is printed with a decolorable toner, by heating thereof, is known. The term "decoloring" as used herein indicates that an image is printed using a recording material such as toner or ink, having incorporated therein a coloring agent having a decolorable property, and, as a result of "decoloring", an image formed using this material can be changed from visible to, to substantially non-visible to, the human eye.

In addition, there is known an image forming apparatus capable of performing image formation and decoloring.

However, when a user attempts to perform decoloring, e.g., a "decoloring job", using a decoloring apparatus or an image forming apparatus, the apparatus may already be performing another job, i.e., it may be busy. In this case, the user needs to wait until the job being performed has ended to begin the decoloring job.

DESCRIPTION OF THE DRAWINGS

FIG. 8 is a diagram showing an example of a job management table on a side of the image processing apparatus according to the first embodiment;

DETAILED DESCRIPTION

Figure 1:
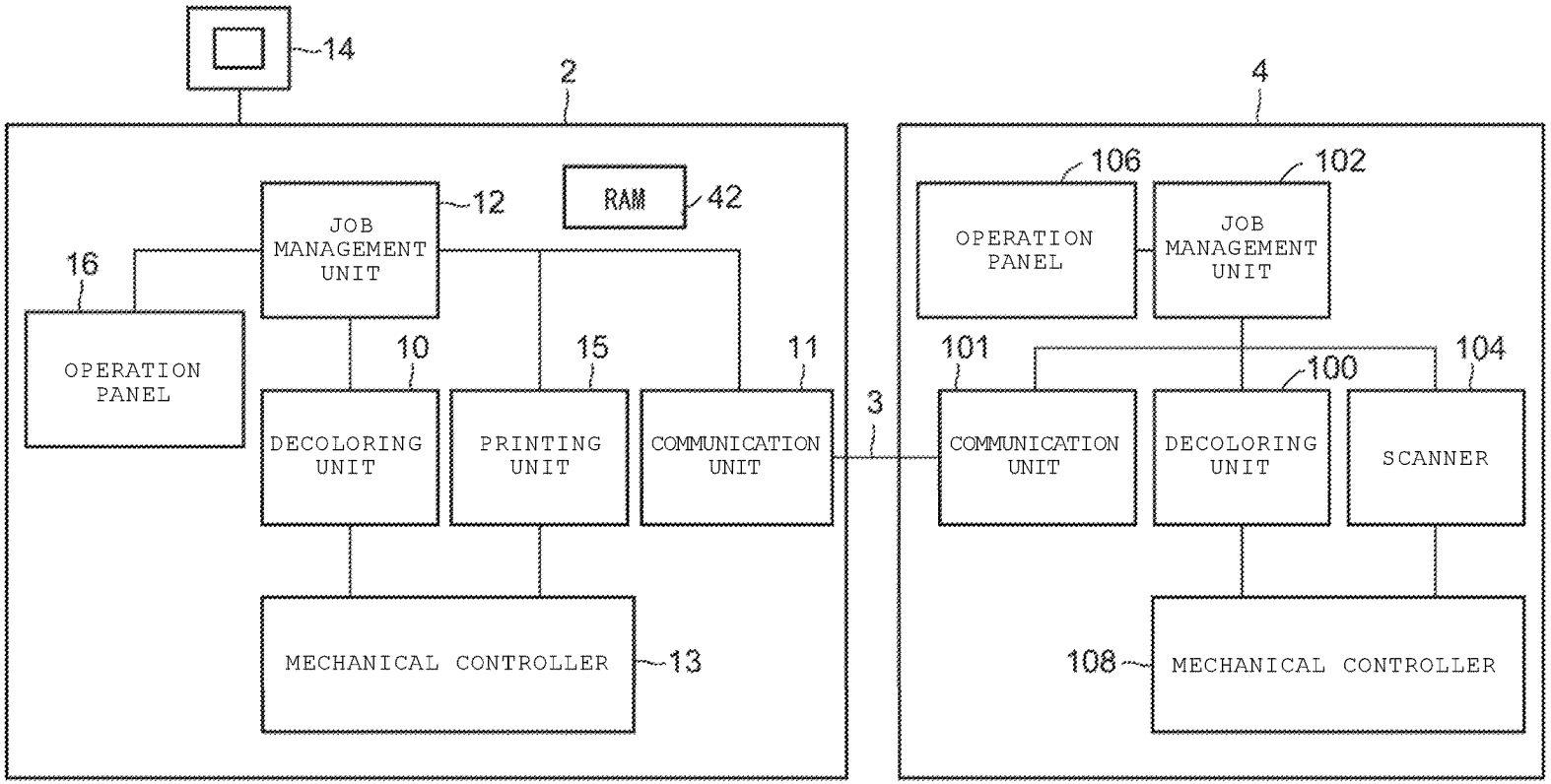
FIG. 1 is a diagram showing a configuration example of an image processing apparatus according to a first embodiment.

Embodiments provide an image processing apparatus for decoloring a decolorable toner image formed on one or more sheets, including an image processing unit comprising a controller and an image heating section, wherein the image heating section is selectively operable at a toner fixing temperature and an image decoloring temperature that is higher than the toner fixing temperature, a communication interface configured to communicate with an external decoloring device, and a user input section. The controller, upon receiving a request to decolor one or more sheets that is made through the user input section, determines which of the image heating section and the external decoloring device will be the first available to decolor the one or more sheets.

Hereinafter, an image processing apparatus according to an embodiment will be described in detail with reference to the accompanying drawings. In addition, the same components in the drawing will be denoted by the same reference numerals and signs, and a description thereof will not be repeated.

First Embodiment

FIG. 1 is a diagram showing a configuration example of an image processing apparatus according to a first embodiment.

The image processing apparatus according to the first embodiment includes a multi-function peripheral (MFP) 2 (which is an example of a first image processing unit) and a decoloring apparatus 4 (which is an example of a second image processing unit).

The MFP 2 hereof includes a decoloring unit 10 (first decoloring unit). The decoloring unit 10 performs both image fixing and image decoloring.

The decoloring apparatus 4 includes a decoloring unit 100 (second decoloring unit) to perform decoloring. The decoloring apparatus 4 is electrically connected to the MFP 2 through a signal line 3.

The MFP 2 includes the decoloring unit 10, a communication unit 11, a RAM 42 (memory), and a job management unit 12 (controller). The term "job" as used herein refers to an image forming job, such as copying and printing, and a decoloring job.

The decoloring unit 10 performs a decoloring process on a sheet (medium) on which an image was formed with a decolorable toner (recording material). The term "sheet" as used herein indicates plain paper or recycled paper.

The communication unit 11 communicates with the decoloring apparatus 4.

The RAM 42 is a memory that stores job information. The job management unit 12 is a controller that manages a job stored in the RAM 42. The job management unit 12 determines which of the decoloring unit 10 and the decoloring unit 100 should be used to perform a decoloring process on one or more sheets, based on information received from the communication unit 11 and job information stored in the RAM 42.

The job management unit 12 manages one or more jobs intended to be performed on the MFP 2.

The MFP 2 performs image forming, "an image forming job" using the printing unit 15 when in an image forming mode. The MFP 2 performs decoloring, "a decoloring job" using the decoloring unit 10 when in a decoloring mode. The MFP 2 does not simultaneously operate in both the image forming mode and the decoloring mode. In the image forming mode, the decoloring unit fixes the toner image formed on the sheet in the MFP2

Figure 3:
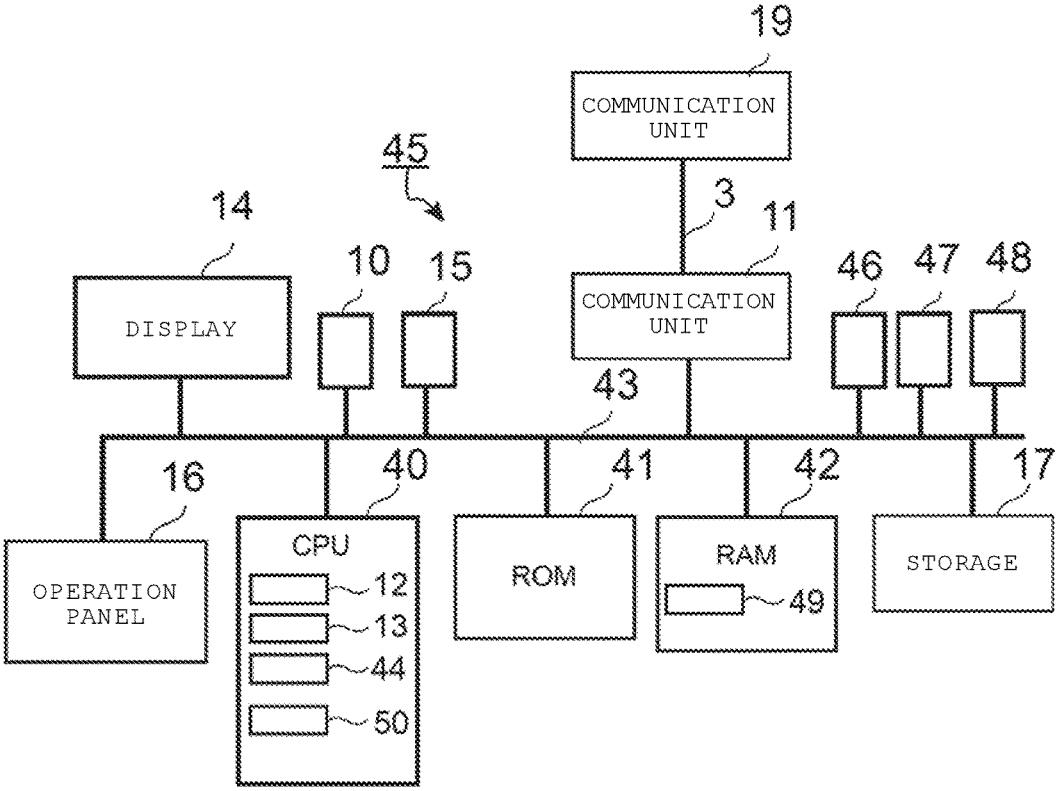
FIG. 3 is a functional block diagram showing a control system of the image processing apparatus according to the first embodiment as a main body.

The job management unit 12 is composed of the RAM 42 and the CPU 40 that manages a job stored in the RAM 42, as shown in FIG. 3.

Further, the MFP 2 includes a display 14 and an operation panel 16.

The display 14 displays the setting information of the MFP 2, the operation status of the MFP, a log, a message for a user, and the like. The display 14 includes, for example, a liquid crystal display, and a touch panel on the liquid crystal display.

The operation panel 16 receives instructions provided by a user input, and displays information. The term "instruction" as used herein indicates the start of copying, the start of decoloring, and the number of sheets to be decolored. The operation panel 16 includes numeric keys, a stop key, a start key, and the like.

Figure 2:
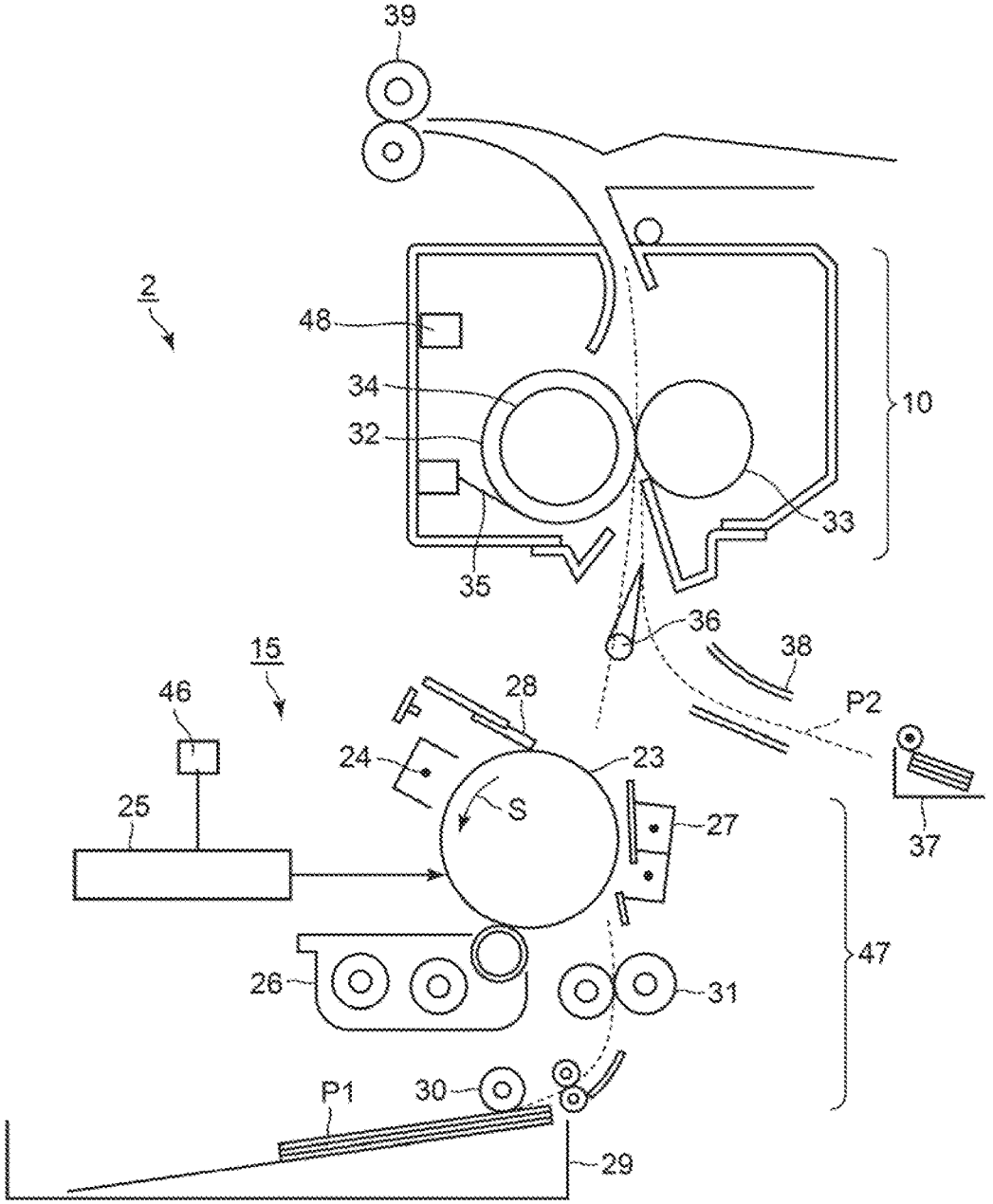
FIG. 2 is a diagram showing a configuration example of the image processing apparatus according to the first embodiment.

FIG. 2 is a diagram showing a configuration example of a portion of the MFP 2 according to the first embodiment. In the figure, the reference numerals which have been already mentioned denote the same components as the corresponding components mentioned above.

The decoloring unit 10 fixes an unfixed toner image, formed by the printing unit 15 onto a sheet, when in an image forming mode. The decoloring unit 10 can also decolor a decolorable image formed on a sheet, and thus function as an image fixing unit and an image decoloring unit.

The MFP 2 includes a guide finger 36 positioned between the decoloring unit 10 and the printing unit 15.

The guide finger 36 guides any one of a sheet (denoted by P1) fed from the printing unit 15, and a sheet (denoted by P2) sent from the cassette 37, to the decoloring unit 10.

A bundle of sheets (one or more sheets) to be decolored is placed in the cassette 37.

The guide finger 36 guides a sheet sent from the printing unit 15 to the decoloring unit 10 when an image forming mode is selected as the operation mode of the MFP 2.

The guide finger 36 guides a sheet sent from the cassette 37 to the decoloring unit 10 through a guide 38 when the decoloring mode is selected as the operation mode of the MFP 2.

The decoloring unit 10 includes a heat roller 32 and a press roller 33. The heat roller 32 and the press roller 33 heat and press a sheet interposed and passing between them.

The heat roller 32 heats a sheet as it passes over the surface of the heat roller 32. The heat roller 32 may include a cylindrical cylinder, having a polytetrafluoroethylene (PTFE) layer as a surface coating of the cylinder.

The press roller 33 presses a sheet interposed between the heat roller 32 and the press roller 33 against the heat roller 32. The press roller 33 may include a metal shaft and an elastic layer formed on the surface of the shaft.

The decoloring unit 10 may also include an induction heating (IH) coil 34 inside the heat roller 32.

The decoloring unit 10 may include a temperature sensor (thermistor) 35 that detects the temperature of surface of the heat roller 32.

The decoloring unit 10 includes a temperature controller 48. The temperature controller 48 controls the current passing through the IH coil 34 and thus the temperature of the heat roller 32.

The temperature controller 48 changes the temperature of surface of the heat roller 32 based on whether an image forming job or a decoloring job is to be performed in the decoloring unit 10.

When the sheet entering the decoloring unit is for an image forming job, the decoloring unit 10 sets the temperature of the heat roller 32 to a temperature of equal to or less than 100° C., for example, 80° C., which is a temperature capable of fixing a toner image on a sheet.

When the sheet entering the decoloring unit is for a decoloring job, the decoloring unit 10 sets the temperature of the heat roller 32 to a temperature of equal to or greater than 90° C., for example, 140° C., which temperature is capable of decoloring a fixed toner image previously formed on a sheet.

A decolorable coloring material is used as the decolorable toner. The decolorable coloring material includes a coloring compound, a developer, and a decoloring agent.

In the embodiment, the coloring compound is a leuco dye, the developer is a phenol-based developer, and the decoloring agent is a material that melts together with the coloring compound when heated. A material that does not have an affinity with the developer is used as the decoloring agent.

The decolorable coloring material develops a color by chemical interaction between the coloring compound and the developer.

The decolorable coloring material blocks the interaction between the coloring compound and the developer when heated to a decoloring temperature or a temperature higher than the decoloring temperature. The coloring material is decolored as a result of this blocking.

In FIG. 2, the printing unit 15 forms a toner image on a sheet.

The printing unit 15 includes a photoreceptor drum 23, a charger 24, an exposure device 25, a developing device 26, a transfer device 27, and a cleaner 28.

The photoreceptor drum 23 rotates in the counterclockwise direction of arrow S in FIG. 2.

The charger 24 charges the surface of the photoreceptor drum 23.

The exposure device 25 exposes the surface of the photoreceptor drum 23 to a laser beam or an exposure wavelength of a light emitting diode (LED).

The developing device 26 develops an electrostatic latent image formed on the photoreceptor drum 23 with the toner.

The transfer device 27 transfers the toner image onto a sheet.

The cleaner 28 cleans the surface of the photoreceptor drum 23 after the image thereon is transferred to a sheet.

In an image forming mode, the page memory 46 stores image data in accordance with an image forming job received by the job management unit 12.

The photoreceptor drum 23 starts rotating in the direction of arrow S. The charger 24 charges the surface of the photoreceptor drum 23 at a constant voltage.

The exposure device 25 modulates light based on image data. The exposure device 25 irradiates an irradiation position on the photoreceptor drum 23 with light.

At least one roller 30 moves a sheet from a cassette 29. The conveying mechanism 47 pulls the sheet moved by the roller 30 from the cassette 29. The conveying mechanism 47 includes a plurality of pairs of rollers, a driving motor for each of the rollers, and a guide (not shown in the drawing).

A pair of resist rollers 31 synchronizes the timing at which a sheet is fed to the transfer device 27 with a timing at which a toner image is formed.

The decoloring unit 10 fixes a toner image onto a sheet above the printing unit 15.

The MFP 2 discharges the sheet using a pair of discharge rollers 39.

In the decoloring mode, the conveying mechanism 47 feeds a sheet from the cassette 37 through the guide 38 to the decoloring unit 10 in accordance with an input for starting a decoloring job.

The temperature controller 48 controls the temperature of the surface of the heat roller 32 to be a predetermined temperature for a decoloring job when sheet(s) to be decolored are pulled from cassette 37.

The decoloring unit 10 decolors the toner by heating the image to the decoloring temperate. The MFP 2 discharges a decolored sheet using the pair of discharge rollers 39.

Referring back to FIG. 1, a mechanical controller 13 controls the conveying mechanism 47, and causes the sheet conveying speed during a decoloring job be lower than the sheet conveying speed during an image forming job. The mechanical controller 13 controls switching between the positions of the guide finger 36.

FIG. 3 is a functional block diagram showing a control system of the image processing apparatus according to the first embodiment. The above-mentioned reference numerals and signs denote the same components as the corresponding components mentioned above.

A control system 45 includes a communication unit 11 connected to a bus 43. The communication unit 11 is a serial communication module configured as an integrated circuit (IC). The signal line 3 is a serial communication cable.

The communication unit 11 performs signal conversion and communication control based on, for example, a universal asynchronous receiver/transmitter (UART) protocol.

A communication unit 19 on the decoloring apparatus 4 side also has substantially the same configuration as that of the communication unit 11.

One of the communication unit 11 and the communication unit 19 requests the other one to communicate therewith, and the other one responds to the request, and thereby a data link of asynchronous serial communication between the MFP 2 and the decoloring apparatus 4 is established.

The data link is established when the MFP 2 and the decoloring apparatus 4 are started. After the MFP 2 and the decoloring apparatus 4 are started, the communication unit 11 and the communication unit 19 continue to communicate with each other.

In addition, the control system 45 includes a storage 17, a central processing unit (CPU) 40, a read only memory (ROM) 41, and a random access memory (RAM) 42 connected to the bus 43.

The storage 17 stores an operating system (OS) and application programs. For example, a hard disk drive or a silicon disk drive is used as the storage 17.

The CPU 40 performs the function of the job management unit 12 (controller) together with the ROM 41 and the RAM 42. The CPU 40 performs functions of a main controller 44 and the mechanical controller 13.

The ROM 41 stores programs which are executed by the CPU 40.

The ROM 41 or the storage 17 may store condition information necessary for image forming and decoloring. The condition information includes a temperature, a time length, and various setting values.

The RAM 42 (memory) stores a job management table 49.

For example, the CPU 40 loads a job management table on the OS side into the RAM 42.

The job management unit 12 registers a time at the initiation of a decoloring job until the completion of a decoloring job, in the RAM 42.

The job management unit 12 registers a time, at the initiation of an image forming job until the completion of an image forming job, in the RAM 42.

The job management unit 12 will now be described in more detail.

The job management unit 12 transmits/receives information or a message such as (a1) to (a10) as set forth hereafter to/from the decoloring apparatus 4.

(a1) The job management unit 12 transmits an inquiry about whether or not the decoloring unit 100 is available to perform a decoloring process to the decoloring apparatus 4 through the communication unit 11.

(a2) After the job management unit 12 transmits a request for the execution of a decoloring process to the decoloring apparatus 4, the job management unit 12 causes the display 14 to display acceptability of a decoloring job by the decoloring unit 100 when a message is received from the decoloring apparatus 4 that it is currently able to perform a decoloring job.

Herein, "Affirmative" indicates that the decoloring request is accepted.

(a3) The job management unit 12 transmits a request to recover from the power saving state to the decoloring apparatus 4 through the communication unit 11.

(a4) In (a3), the job management unit 12 causes the display 14 to display acceptance of the request for recovering from the power saving state received from the decoloring apparatus 4.

(a5) When the MFP 2 is performing a decoloring job, the job management unit 12 transmits an inquiry to request the time until the completion of a decoloring job by the decoloring unit 100, to the decoloring apparatus 4 through the communication unit 11.

Regarding the time length until the completion of the decoloring job, a remaining time calculated by a job management unit 102 of the decoloring apparatus 4 indicates, for example, "eight minutes" with respect to the decoloring job.

(a6) The job management unit 12 compares the time until the completion of a second decoloring job of the decoloring unit 100 which is received from the decoloring apparatus 4 with the time until the completion of a first decoloring job being performed in the decoloring unit 10, which information is registered in the RAM 42. The job management unit 12 causes the display 14 to display a comparison result.

(a7) When the MFP 2 is executing an image forming job, the job management unit 12 inquires of the decoloring apparatus 4 about the time until the completion of a decoloring job by the decoloring unit 100, through the communication unit 11.

(a8) The job management unit 12 adds the time until the completion of an image forming job stored in the RAM 42 and the time required for the change-over of the temperature of the decoloring unit 10 to the decoloring temperature. The job management unit 12 compares the addition result with the time until the completion of a decoloring job by the decoloring unit 100 received from the decoloring apparatus 4, and causes the display 14 to display the comparison result.

(a9) When the MFP 2 is performing a decoloring job, the job management unit 12 inquires of the decoloring apparatus an estimated time until the decoloring unit 100 completes the decoloring job being performed therein, through the communication unit 11.

(a10) In (a9), the job management unit 12 compares an estimated time until the completion of a decoloring job stored in the RAM 42 with an estimated time to complete the decoloring job received from the decoloring apparatus 4. The job management unit 12 causes the display 14 to display the comparison result. Note that, in each case, the time until a job is completed in either of the MFP 2 or the decoloring apparatus 4 will be 0 if no job is being performed therein.

Further, in FIG. 3, the CPU 40 may perform the function of a state management unit 50. The state management unit 50 manages the operation mode of the MFP 2 to be set to be either the image forming mode or the decoloring mode. The state management unit 50 manages the state of the MFP 2 to be set to be either an immediately available or active (normal) state or a power saving state.

Further, the control system 45 includes a page memory 46. The page memory 46 stores image data to be printed by the printing unit 15.

The MFP 2 is mainly described above, and the decoloring apparatus 4 will now be described.

As shown in block form in FIG. 1, the decoloring apparatus 4 includes the decoloring unit 100 (second decoloring unit), a communication unit 101, a job management unit 102, a scanner 104, and an operation panel 106.

The decoloring unit 100 decolors, by heating, an image which was previously formed on a sheet using a decolorable toner.

The decoloring apparatus 4 causes the decoloring apparatus 4 to shift to the power saving state after the decoloring unit 100 completes a decoloring job.

The communication unit 101 communicates with the decoloring unit 10 on the MFP 2 side.

The communication unit 101 receives an inquiry about whether a decoloring job can be currently performed using the decoloring apparatus 4. The communication unit 101 returns the determination result of the job management unit 102 to the MFP 2.

The job management unit 102 receives, from the MFP 2, an inquiry about whether a decoloring job can be currently performed using the MFP2. The job management unit 102 transmits/receives information or a message such as (b1) to (b3) to/from the MFP 2 by the reception of the inquiry.

(b1) The job management unit 102 transmits an affirmative message indicating acceptance (yes, a decoloring job can be performed now) to the MFP 2 in a case where a decoloring job can be received and executed immediately or nearly immediately.

(b2) In a case where the job management unit 102 receives a request to recover from the power saving state while the decoloring apparatus 4 is in a power saving state, the job management unit transmits a response to the request to recover from the power saving state to the MFP 2.

(b3) The job management unit 102 calculates the time until the completion of the decoloring job by the decoloring unit 100, upon the reception of an inquiry for such information received during the execution of the decoloring job.

For example, the job management unit 102 calculates the remaining time (for example, "eight minutes") required to complete the decoloring job.

The job management unit 102 transmits the remaining time to complete the decoloring job to the MFP 2.

In addition, the job management unit 102 manages the decoloring job in the decoloring apparatus 4.

The scanner 104 reads the surface of the decolored sheet. The scanner 104 determines the success or failure of completion of the decoloring process using the read image of the sheet.

The operation panel 106 receives an instruction provided thereto by a user's input. The operation panel 106 displays information on a window 111 (FIG. 4).

Figure 4:
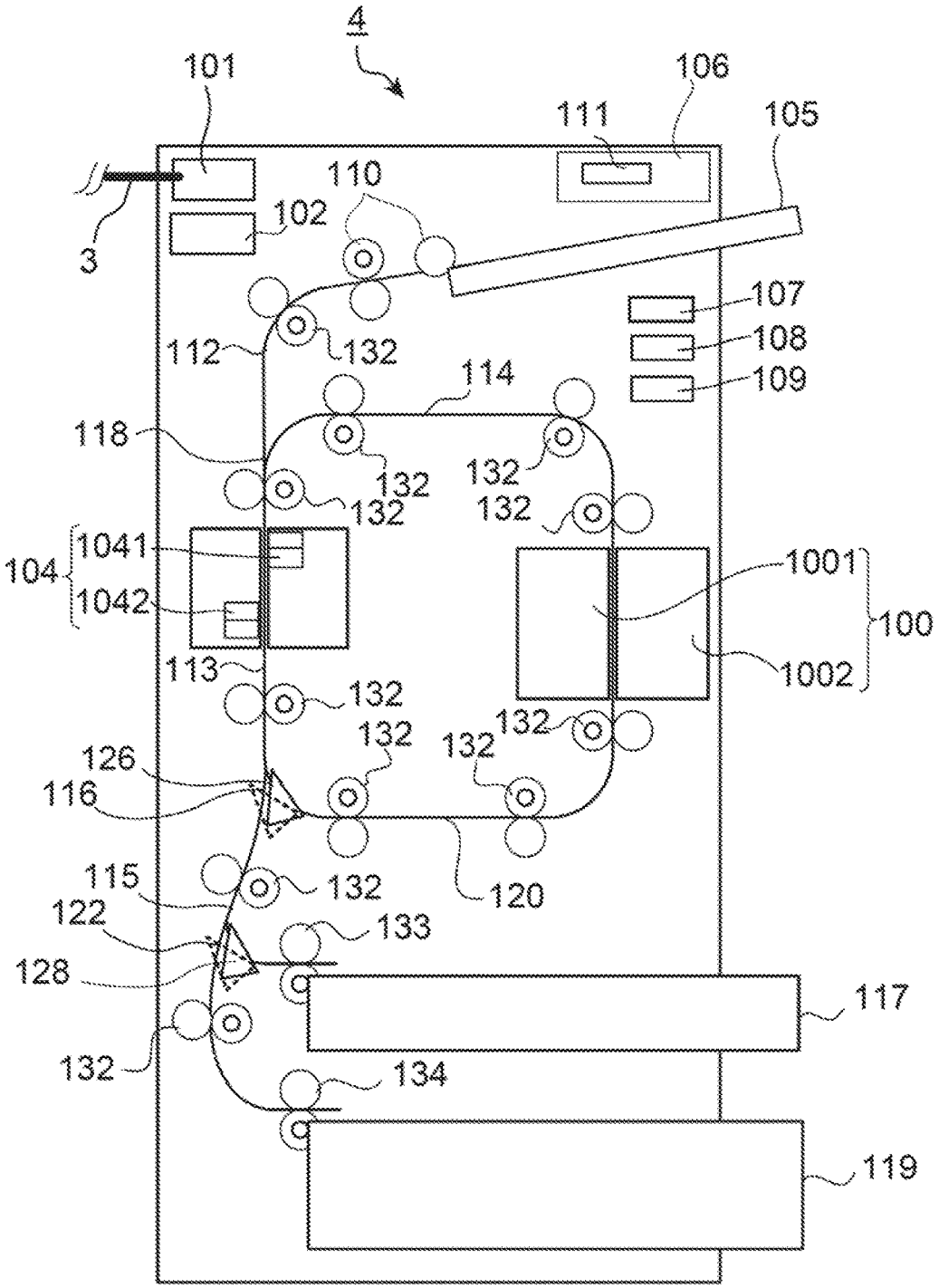
FIG. 4 is a diagram showing a configuration of another image processing apparatus communicating with the image processing apparatus according to the first embodiment.

FIG. 4 is a schematic configuration diagram of the decoloring apparatus 4 (another image processing apparatus). The reference numerals which have been already mentioned denote the same components as the corresponding components mentioned above.

The decoloring apparatus 4 includes a tray 105 on the most upstream side thereof in a sheet conveying direction. A sheet on which the image is to be decolored is fed from the tray 105.

The decoloring apparatus 4 includes a paper feeding unit 110 and a plurality of pairs of rollers 132 on a downstream side of the tray 105 in the sheet conveying direction.

The paper feeding unit 110 feeds sheets one by one from the tray 105 to a guide 112.

The plurality of pairs of rollers 132 feed a sheet.

The decoloring apparatus 4 includes a junction 118 below the guide 112.

The decoloring apparatus 4 includes the scanner 104 below the junction 118. The scanner 104 includes scanners 1041 and 1042.

The scanner 1041 is a charge coupled device (CCD) scanner or a complementary metal oxide semiconductor (CMOS) sensor. The scanner 1042 has substantially the same structure as the scanner 1041, and is configured to read an image on the side of the sheet opposed to the side of the sheet read by scanner 1041.

Further, the decoloring apparatus 4 includes a main controller 107 and a mechanical controller 108.

The main controller 107 controls the overall decoloring apparatus 4.

The mechanical controller 108 controls the conveyance of a sheet in the decoloring apparatus 4.

The decoloring apparatus 4 includes a guide 113, a first branch point 116, and guide fingers 126 and 128 below the scanner 104.

The guide finger 126 is positioned at a first branch point 116. The guide finger 126 guides a sheet sent from the guide 113 toward either a guide 115 or a guide 120.

The mechanical controller 108 changes the angular position states of the respective guide fingers 126 and 128 to select a path of a sheet after it passes the guide fingers 126, 128.

The decoloring apparatus 4 includes the decoloring unit 100 on the downstream side in a sheet conveying direction from the first branch point 116 in the sheet path direction toward the guide 120.

The decoloring unit 100 includes a decoloring unit 1001 on a first surface side of the sheet path and a decoloring unit 1002 on a second surface side of the sheet path.

The decoloring unit 1001 decolors an image formed in an image region on a first side of a sheet by heating the image/sheet. The decoloring unit 1002 decolors an image formed in an image region on a second side of a sheet by heating the image/sheet and has substantially the same function as the decoloring unit 1001.

A sheet conveying path from an outlet of the scanner 104 to an inlet of the scanner 104 through the decoloring unit 100 forms a selectively closed loop.

If the main controller 107 changes the position of the guide finger 126 to a first angular position, the decoloring apparatus 4 causes a sheet, which is fed from the tray 105, to travel along the closed loop in the order of the scanner 104, the decoloring unit 100, and the scanner 104.

The decoloring apparatus 4 includes a guide 114 above the decoloring unit 100. The junction 118 is positioned on a downstream side of the guide 114 (left side in the drawing) in a sheet conveying direction.

Further, the decoloring apparatus 4 includes a second branch point 122 below the guide 115.

The decoloring apparatus 4 includes the guide finger 128 at the second branch point 122. The guide finger 128 guides a sheet sent from the guide 115 toward either a reuse tray 117 or a reject tray 119.

A discharge roller 133 discharges a sheet to be reused to the reuse tray 117 where the read result of the scanner 1040 indicates that the image was acceptably decolored.

A discharge roller 134 discharges a rejected sheet to the reject tray 119 where the read result of the scanner 1040 indicates that the image was not acceptably decolored.

Figure 5:
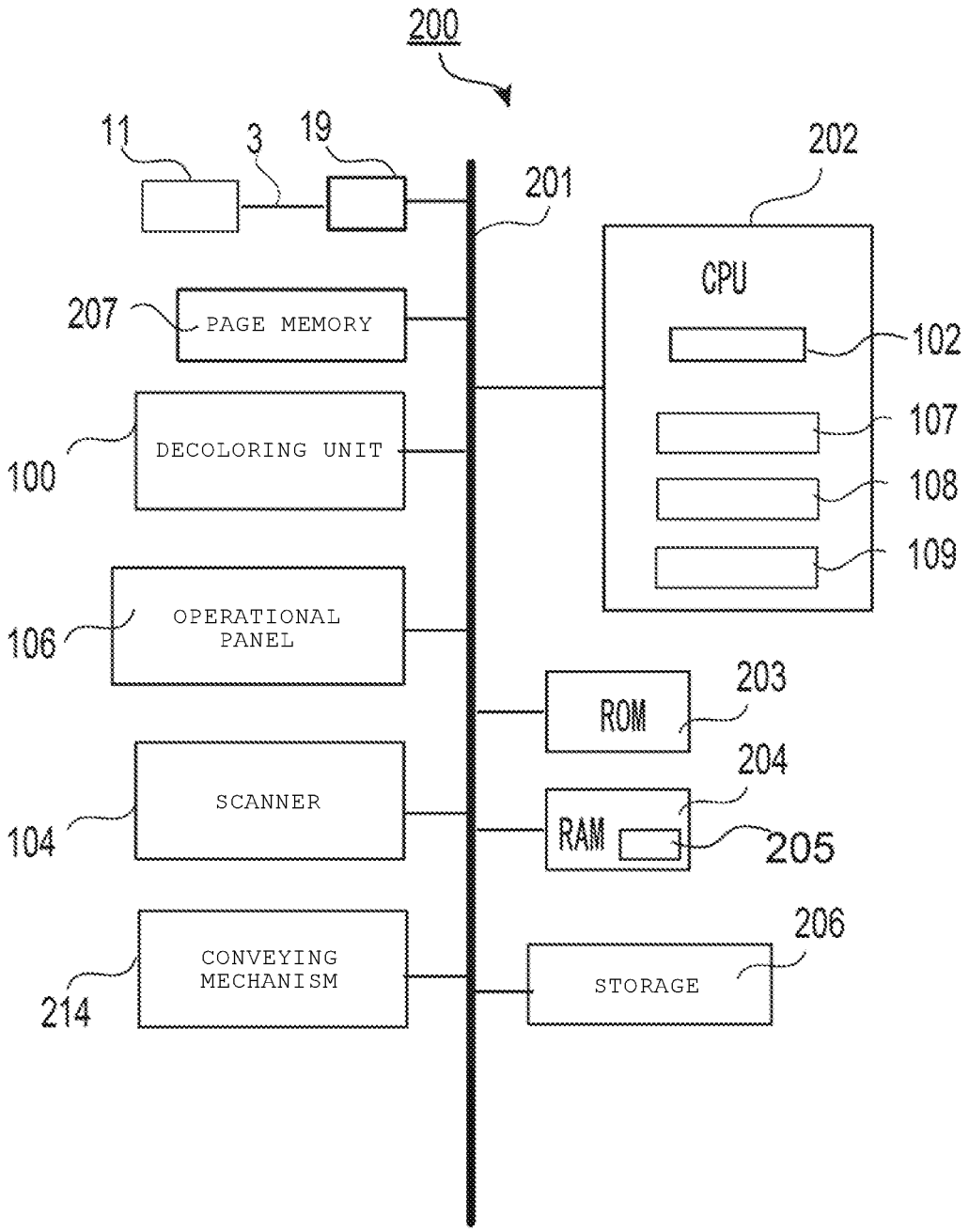
FIG. 5 is a block diagram of a control system of another image processing apparatus communicating with the image processing apparatus according to the first embodiment.

FIG. 5 is a block diagram of a control system of the decoloring apparatus 4. The above-mentioned reference numerals and signs denote the same components as the corresponding components mentioned above.

The control system 200 includes a CPU 202, a ROM 203, a RAM 204, a storage 206, and a conveying mechanism 214 connected on a bus 201 of the image forming apparatus.

The CPU 202, together with the ROM 203 and the RAM 204, performs the function of a job management unit 102. The CPU 202 performs functions of a main controller 107 and a mechanical controller 108.

The CPU 202 may perform the function of a state management unit 109. The state management unit 109 manages whether or not the state of the decoloring apparatus 4 is a power saving state.

The job management unit 102 stores, in the RAM 204, a length of time until the completion of a decoloring job based on the occurrence of a decoloring job.

The ROM 203 stores a program to be executed by the CPU 202.

The ROM 203 or the storage 206 may store condition information necessary for decoloring. The condition information indicates a temperature, a time length, and various setting values.

The RAM 204 stores a job management table 205.

For example, the CPU 202 loads a job management table on the OS side into the RAM 204.

The storage 206 stores an OS and an application program. For example, a hard disk drive or a silicon disk drive is used as the storage 206.

The conveying mechanism 214 includes the paper feeding unit 110, the plurality of pairs of rollers 132, and a driving motor for each of the rollers 132. The conveying mechanism 214 also includes the guide fingers 126 and 128, the reuse tray 117, the reject tray 119, the guide 112, and the like.

The control system 200 includes a page memory 207. The page memory 207 stores a bitmap image scanned by the scanner 104.

In addition, the main controller 107 controls the overall operation of the decoloring apparatus 4. The mechanical controller 108 controls the conveyance of a sheet.

The main controller 107 causes the conveying mechanism 214 to convey a sheet to the decoloring unit 100 when that sheet is output from the scanner 104.

The main controller 107 causes the conveying mechanism 214 to convey a sheet to the scanner 104 again the sheet is output from the decoloring unit 100.

Figure 6:
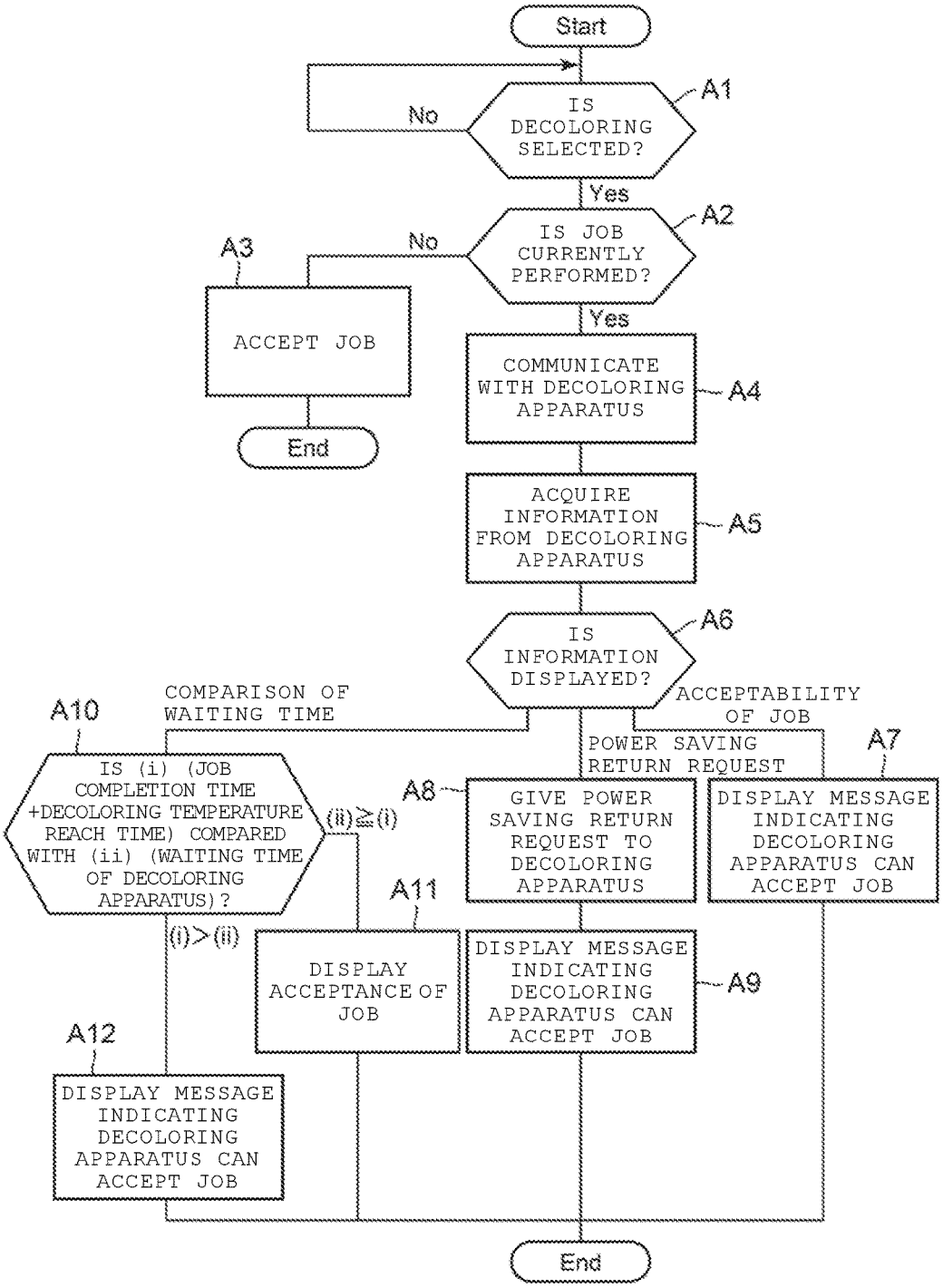
FIG. 6 is a flow chart showing a message display control method performed by the image processing apparatus according to the first embodiment.

FIG. 6 is a flow chart showing a message display control method performed by the image processing apparatus according to the first embodiment.

The operation of the MFP 2 having the above-described configuration is now described with reference to specific operating states of the MFP2 and the decoloring apparatus 4, with reference in part to the operation flow chart of FIG. 6.

Operating state 1: The MFP 2 is not executing an image forming job or a decoloring job.

The not in use MFP 2 starts processing in accordance with an input by a user into the operation panel 16, requesting decoloring of a sheet.

The operation panel 16 receives an input of the number of sheets to be decolored. The operation panel 16 transmits information regarding the number of sheets to be decolored to the main controller 44.

In act A1, the main controller 44 of the MFP 2 determines whether or not decoloring has been is selected (input) by a user depressing a decoloring button or location on the touch panel.

In act A1, the main controller 44 returns to the state prior to act A1 (No) when decoloring is not selected.

When decoloring is selected by a user input (act A1), the main controller 44 determines in act A2 whether the MFP 2 is currently executing an image forming job or a decoloring job (act A2) as a result of decoloring being selected in act AI (yes). If, in act A2, the job management unit 12 determines that the MFP 2 is executing neither an image forming job nor a decoloring job (no), the main controller 44 causes the display 14 to display that a decoloring job can be accepted in act A3.

Figure 7:
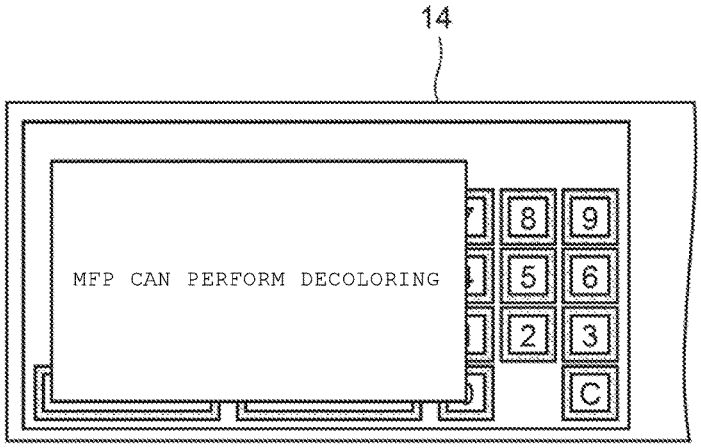
FIG. 7 is a diagram showing a first display example of the image processing apparatus according to the first embodiment.

FIG. 7 is a diagram showing a first display 14 example of the MFP 2, stating that the MFP can perform decoloring.

A user sets a sheet in the cassette 37 of the MFP 2 based on the "MFP can perform decoloring" information displayed on the display 14. The MFP 2 then acts to decolor an image on the sheet. In the case where the MFP 2 is not executing a job, the MFP 2 immediately performs the decoloring process.

Operating state 2: The MFP 2 is executing an image forming job or a decoloring job and the decoloring apparatus 4 is in an active state and is not executing a decoloring job In FIG. 6, the main controller 44 determines whether or not decoloring is selected (act A1).

The main controller 44 continues executing an image forming job or a decoloring job if decoloring has not been selected (No answer in act A1).

If decoloring is selected, the result of the inquiry of act A1 is yes, and the main controller 44 determines whether the MFP 2 is currently executing an image forming job or a decoloring job by the job management unit 12 in act A2.

FIG. 8 is a diagram showing an example of the job management table 49 stored in the RAM memory 42 of the MFP 2. The job management table 49 shows the presence of a decoloring job and two printing jobs which are not yet completed.

In act A2 in FIG. 6, the main controller 44 cause the information in response to the inquiry of act 5 to be displayed based on the job management table 49 indicating that an image forming job or a decoloring job is being executed, and moves to the process of act A4.

In act A4, the MFP 2 starts communicating with the decoloring apparatus 4.

Figure 9:
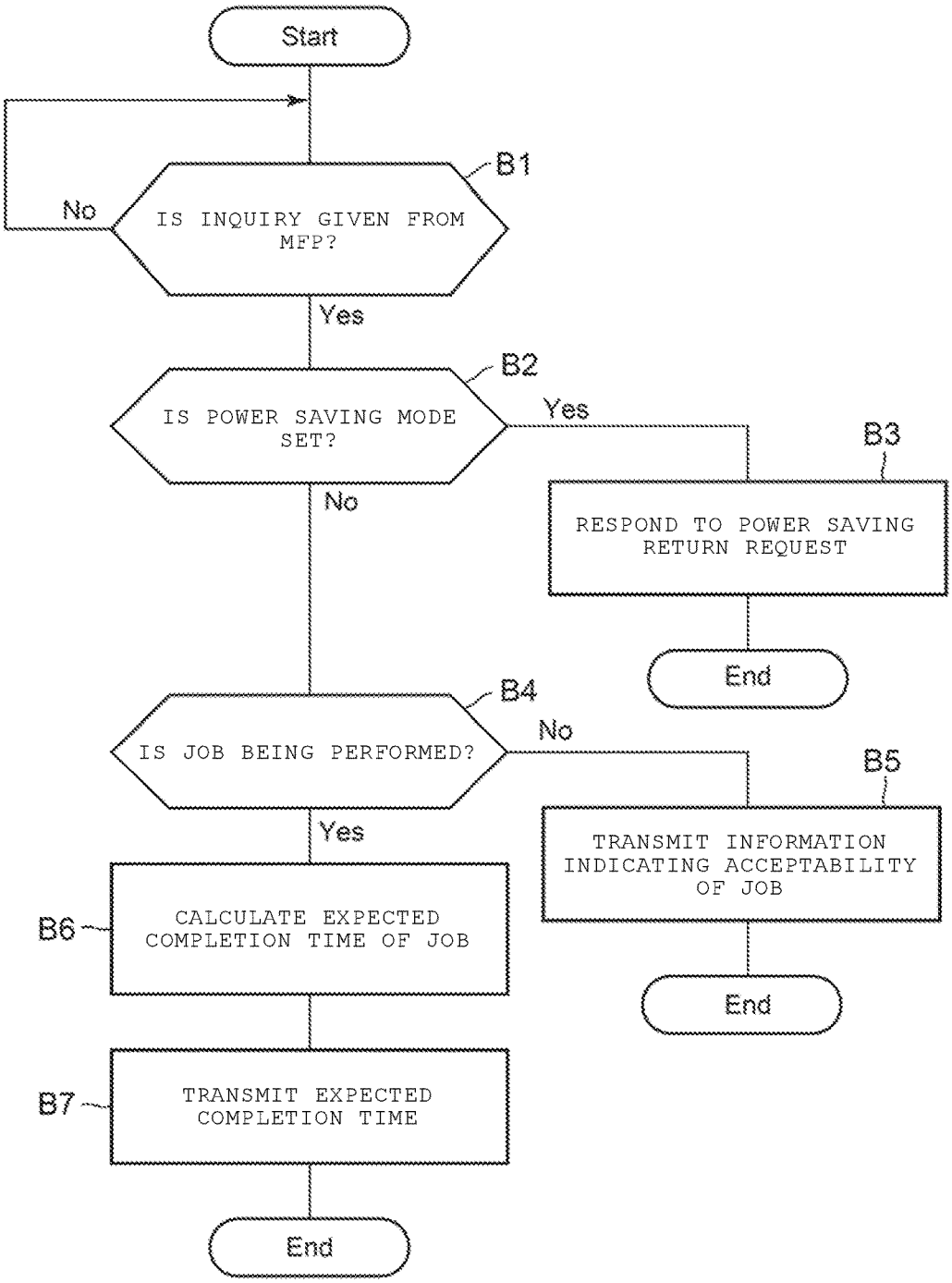
FIG. 9 is a flow chart showing a message display control method performed by another image processing apparatus communicating with the image processing apparatus according to the first embodiment.

FIG. 9 is a flow chart showing a message display control method performed by the decoloring apparatus 4.

In act B1, the main controller 107 of the decoloring apparatus 4 waits for a request from the MFP 2 until a request for communication is received from the MFP 2.

When the decoloring apparatus 4 receives an inquiry from an MFP in act B1, the main controller 107 determines whether or not the decoloring apparatus 4 is in a power saving mode in act B2.

In act B2, the state management unit 109 outputs a determination result indicating whether the decoloring apparatus 4 is not in a power saving mode.

If the decoloring apparatus 4 is not in the power saving mode, the main controller 107 of the decoloring apparatus determines whether or not the decoloring apparatus 4 is executing a decoloring job in act B4. The main controller 107 determines whether or not the decoloring apparatus 4 is currently executing a decoloring job using the job management unit 102.

If the main controller 107 determines that a decoloring job is not currently performed (No), it transmits information indicating the current acceptability of a job to the MFP 2 in act B5, i.e., that the decoloring unit 4 is currently able to accept and execute the job.

In FIG. 6, when the MFP 2 receives the information from the decoloring apparatus 4 (act A5), the MFP 2 reads the received information (act A6).

In a case where the information indicates the acceptability of a job in act A6, the MFP 2 displays the acceptability of a decoloring job on the display 14 in act A7.

Figure 10:
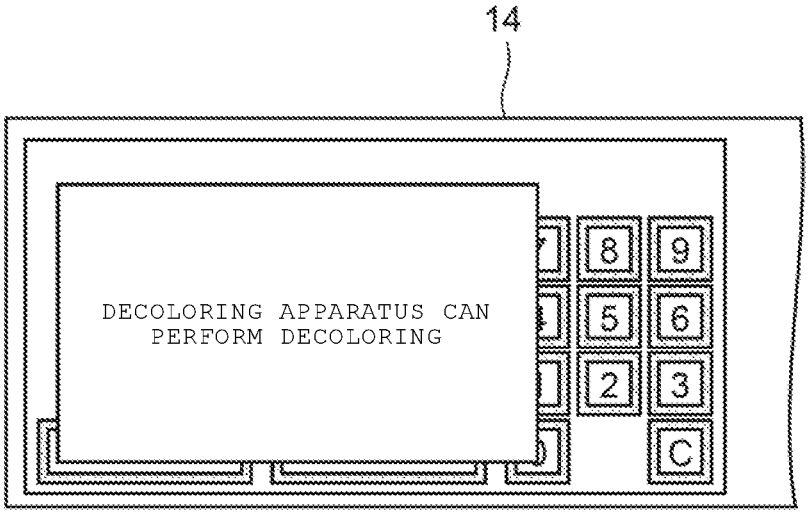
FIG. 10 is a diagram showing a second display example of the image processing apparatus according to the first embodiment.

FIG. 10 is a diagram showing a second display example of the MFP 2. As a result of the display, the user knows to use the decoloring apparatus 4 instead of the MFP 2 for the decoloring job. The user sets the sheet(s) in the tray 105 of the decoloring apparatus 4. The decoloring apparatus 4 performs a decoloring operation on the image on the sheet as a result of a user input.

Thereby, it is possible to eliminate a user wait to execute decoloring by using the decoloring function of the decoloring apparatus 4.

Operating state 3: The MFP 2 is executing an image forming job or a decoloring job and the decoloring apparatus 4 is executing a decoloring job In FIG. 6, in a case where the MFP 2 determines that the MFP 2 is executing an image forming job or a decoloring job, the MFP 2 starts communication with the decoloring apparatus 4 (act A1 to act A4).

The job management unit 102 of the decoloring apparatus 4 determines whether or not the decoloring apparatus 4 is in a power saving mode (act B2) (FIG. 9) as a result of the reception of an inquiry (act A4 of FIG. 6).

Where the main controller 107 determines that the decoloring apparatus 4 is not in a power saving mode, the main controller determines in act B4 whether or not a decoloring job is being performed in the decoloring apparatus 4.

In a case where it is determined in act B4 that the decoloring apparatus 4 is executing a decoloring job, the job management unit 102 calculates an expected completion time, for example in "eight minutes", for the decoloring job in act B6.

In act B7, the decoloring apparatus 4 transmits the expected completion time of the coloring job it is performing to the MFP 2.

In FIG. 6, when the MFP 2 receives information from the decoloring apparatus 4 (act A5), the MFP 2 reads the information in act A6.

In a case where the acquired information indicates an expected completion time of the decoloring job, the main controller 44 executes the process of act A10*ed*.

In act A10, the job management unit 12 compares (i) (job completion time+decoloring temperature reached time for the MFP2) with the (ii) (waiting time before the decoloring apparatus completes the decoloring job).

The job management unit 12 determines the relation between (i) and (ii) based on the type of mode of the MFP 2, reference of the job management table 49, and the number of sheets which is input into the operation panel 16 by the user.

In the case where the MFP 2 is executing an image forming job (image forming mode), (i) (job completion time+decoloring temperature reached time) is the sum of a time required for the MFP 2 to complete the image forming job, a time (reached time) required to change the temperature of the decoloring unit 10 to the decoloring temperature, and thus the time until the decoloring unit 10 can perform decoloring.

Alternatively, in the case where the MFP 2 is executing a decoloring job (decoloring mode), (i) (job completion time+decoloring temperature reached time) is the time required for the MFP 2 to complete the decoloring job. This is because it is not necessary to increase the temperature of the decoloring unit 10 of the MFP 2 to the decoloring temperature.

In addition, (ii) (waiting time of decoloring apparatus) is the expected completion time "eight minutes" for the decoloring job performed by the decoloring apparatus 4.

In act A10, the job management unit 12 calculates the time required for the completion of an image forming job or a decoloring job performed by the MFP 2 based the number of sheets in the job.

In a case where the number of sheets is small, a short completion time is required. In a case where the number of sheets is large, a longer completion time is required.

In act A10, if the job management unit 12 determines that (i) (job completion time+decoloring temperature reached time) is equal to or less than (ii) (waiting time of decoloring apparatus), the main controller 44 causes the display 14 to display that the MFP 2 can accept a decoloring job, as shown in FIG. 7, in act A11 where "(ii)≥(i)" is indicated.

In act A10, if the job management unit 12 determines that (i) (job completion time+decoloring temperature reach time) is longer than (ii) (waiting time of decoloring apparatus), the main controller 44 causes the display 14 to display that the decoloring apparatus 4 can accept a decoloring job, as shown in FIG. 10, in act A12 where "(i)>(ii)" is indicated.

A user selects either the MFP 2 or the decoloring apparatus 4 for the decoloring job based on the information displayed in act A11 or act A12, and decolors an image on a sheet using either the MFP 2 or the decoloring apparatus 4. In this operating state, the decoloring job begins in the designated one of the decoloring apparatus 4 after the job being performed therein is completed.

Thereby, it is possible to reduce the user's waiting time in front of the MFP 2, and the user can efficiently use the decoloring function of the decoloring apparatus 4.

Operating state 4: The MFP 2 is executing an image forming job or a decoloring job and the decoloring apparatus 4 is in a power saving mode In FIG. 6, in the case where the MFP 2 determines that the MFP 2 is executing an image forming job or a decoloring job, the MFP 2 starts communicating with the decoloring apparatus 4 (act A1 to act A4).

In act B1 in FIG. 9, in a case where the decoloring apparatus 4 receives an inquiry from the MFP 2, act B2 determines whether the decoloring apparatus 4 is in a power saving mode. If the main controller 107 finds that the decoloring apparatus 4 is in a power saving mode by the state management unit 109, the main controller 107 transmits a response to the request indicating the decoloring apparatus 4 is in the power saving state to the MFP 2 in act B3, and in act B2, the main controller 107 recovers the state of the decoloring apparatus 4 from a power saving state to an active state.

In FIG. 6, when the MFP 2 receives information from the decoloring apparatus 4 (act A5), the MFP reads the received information in act A6.

In a case where the information indicates a response to a power saving return request in act A6, the main controller 44 determines whether to establish the power saving return request of the decoloring apparatus 4 in act A8 where "power saving return request" is indicated.

In act A9, the main controller 44 causes the display 14 to display that the decoloring apparatus 4 can accept a decoloring job as shown in FIG. 10.

A user decolors an image on a sheet using the decoloring apparatus 4 as a result of the information displayed.

Thereby, it is possible to reduce a user's waiting time in front of the MFP 2, and The user can efficiently use the decoloring function of the decoloring apparatus 4.

In summary, the MFP 2 includes a paper feeding unit (cassettes 29 and 37), functions of fixing an image onto a sheet by heat and decoloring the image by heat (decoloring unit 10), and a paper discharge unit (discharge roller 39) that discharges a sheet which is printed or decolored. The decoloring unit functions as both an image fixing device when operated at image fixing temperatures, and a decoloring apparatus, when operating at a decoloring temperature.

In the decoloring apparatus 4, the decoloring unit 100 has the function of decoloring a sheet. After a decoloring process is performed, the decoloring apparatus 4 reads a sheet surface. The decoloring apparatus 4 determines whether or not the decoloring process is completed. The decoloring apparatus 4 also sorts the sheets after decoloring into reusable and not reusable trays.

It is possible to effectively use the MFP 2 having a decoloring function and the decoloring apparatus 4 having a decoloring function. A user does not need to continuously wait in front of either the MFP 2 or the decoloring apparatus 4. It is thus possible to reduce the waiting time of the user.

It is possible to proficiently use the two apparatuses. It is possible to prevent a user from spending time waiting for the MFP to be ready to perform decoloring.

According to the image processing apparatus of the first embodiment, it is possible to check both the states of the MFP 2 and the decoloring apparatus 4 without any burden on a user.

It is possible to determine which apparatus can complete decoloring in the shortest time.

Even when the decoloring apparatus 4 is in a power saving mode, a user can automatically return the decoloring apparatus 4 from the power saving mode and prepare the decoloring apparatus for a decoloring operation.

Second Embodiment

In the first embodiment, a user causes the MFP 2 to start a decoloring process.

In a second embodiment, a user causes the decoloring apparatus 4 to start a decoloring process, i.e., the user interacts directly with the decoloring apparatus 4.

An image processing apparatus according to the second embodiment is the decoloring apparatus 4. Another image processing apparatus is an MFP 2.

Unless otherwise noted below, the image processing apparatus according to the second embodiment has the same configuration as that of the decoloring apparatus 4 described above. Another image processing apparatus also has the same configuration as that of the MFP 2 described above.

Next, a message display control method performed by the decoloring apparatus 4 having the above-described configuration will be described.

Operating state 5: The decoloring apparatus 4 is sufficiently heated, i.e., is at the decoloring temperature, and is not executing a decoloring job First, the decoloring apparatus 4 displays that the decoloring apparatus 4 can accept a decoloring job on the window 111 thereof.

A user inputs a request for decoloring on an operation panel 106 of the decoloring apparatus 4 in response to the information displayed on the window 111.

Figure 11:
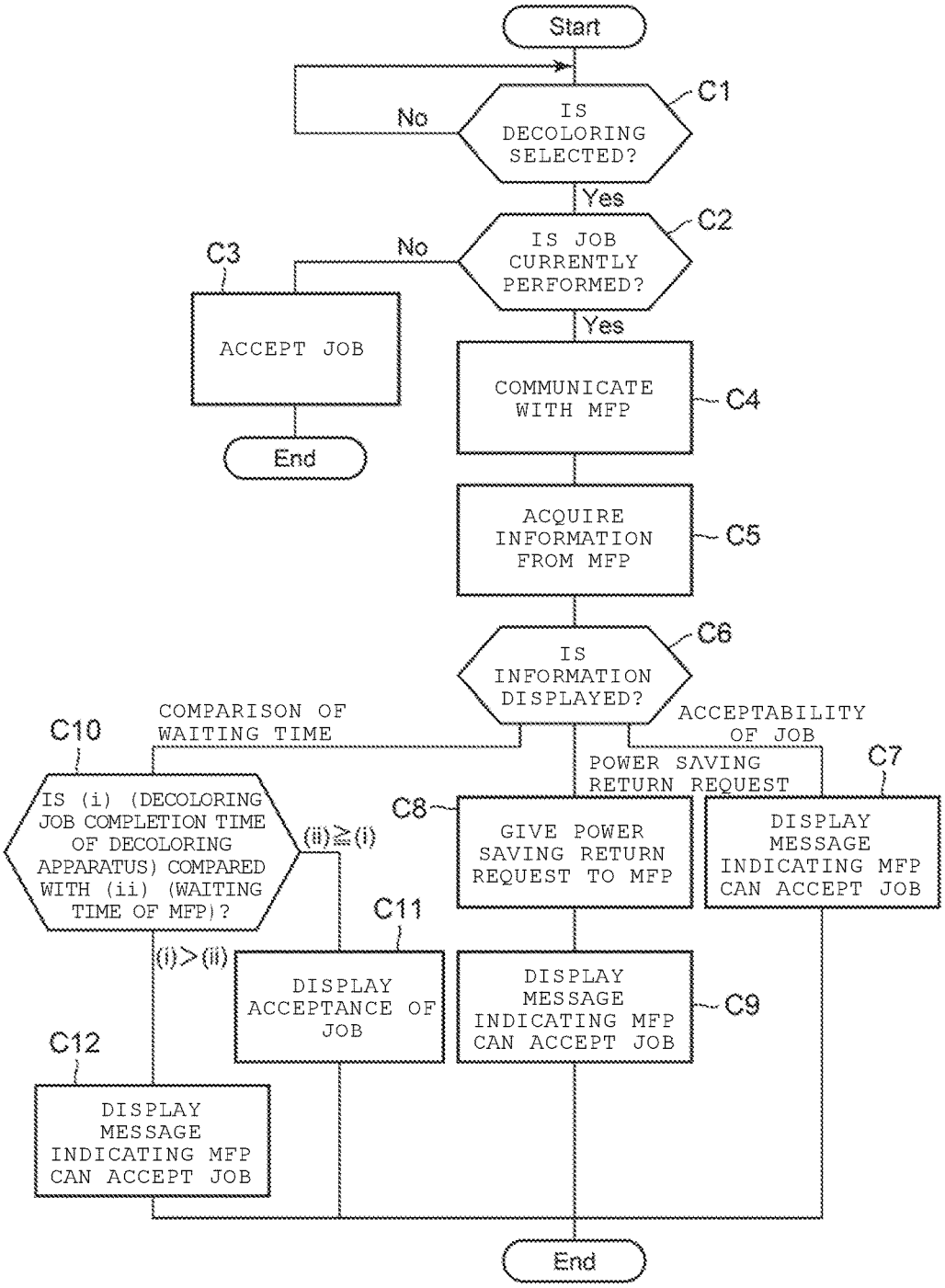
FIG. 11 is a flowchart showing a message display control method performed by an image processing apparatus according to a second embodiment.

FIG. 11 is a flowchart showing a message display control method performed by the image processing apparatus according to the second embodiment.

The main controller 107 of the decoloring apparatus 4 detects a user selection to perform decoloring input to the operation panel 106, and determines whether or not the decoloring apparatus 4 is currently executing a decoloring job in act C2.

If the main controller 107 determines as a result of the job management unit 102 determining that the decoloring apparatus 4 is not executing a decoloring job, the main controller 107 executes act C3 and causes the window 111 to display that a decoloring job is acceptable (may be performed immediately) in act C3.

Thereafter, the decoloring apparatus 4 starts performing a decoloring process on a sheet which is placed in the tray 105 thereof set.

Meanwhile, in a case where the decoloring apparatus 4 is in a power saving state when a user requests a decoloring job, the decoloring apparatus 4 may display that the decoloring apparatus is in a power saving state on the operation panel 106. In that case, the decoloring apparatus 4 may calculate a heating time for the decoloring unit 100 to reach the appropriate decoloring temperature, and display the calculated result on the window 111. In this case, the decoloring apparatus 4 performs the process of act C1 after heating the decoloring unit 100 to the decoloring temperature.

Figure 12:
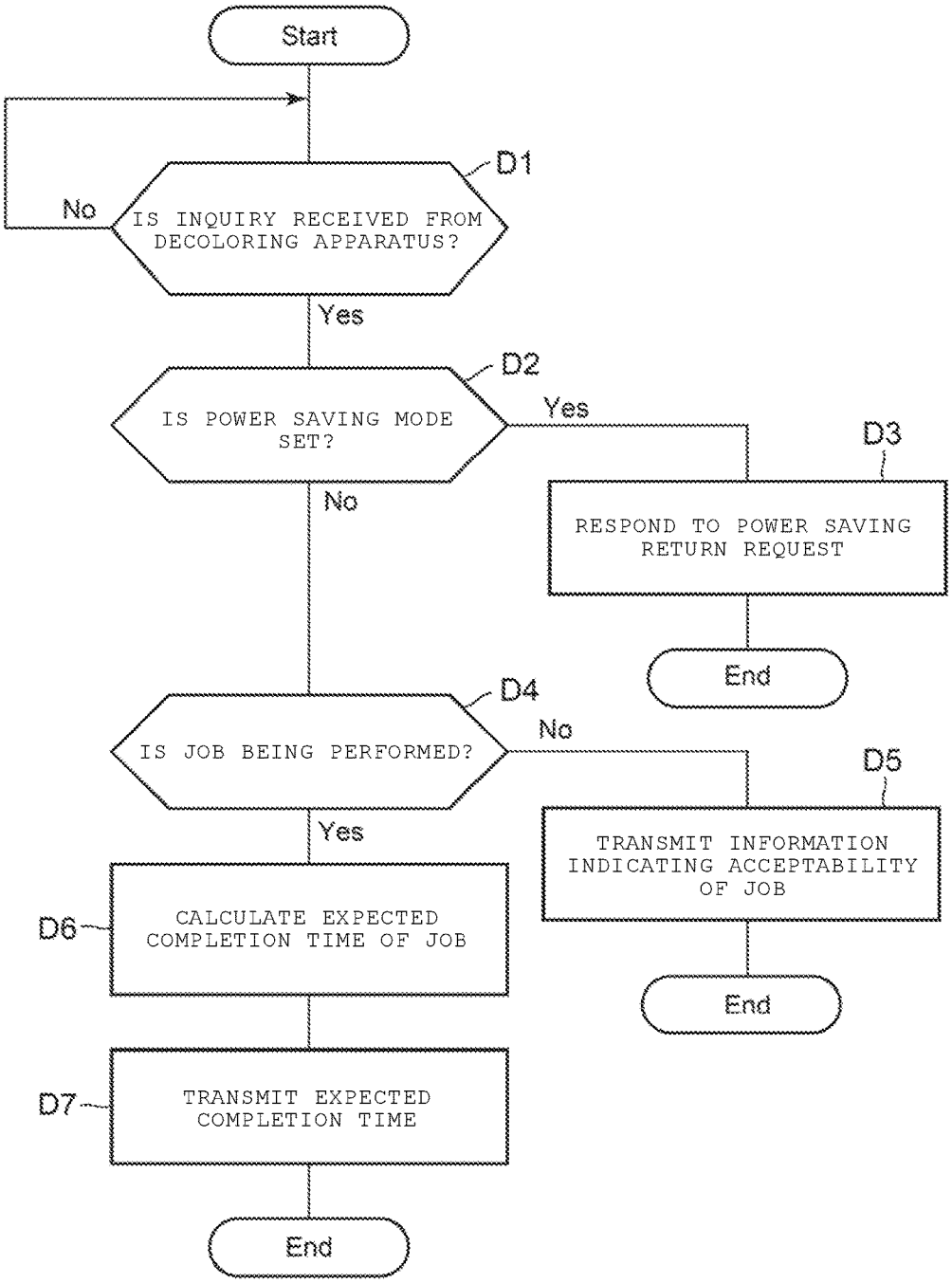
FIG. 12 is a flowchart showing a message display control method performed by another image processing apparatus communicating with the image processing apparatus according to the second embodiment.

Operating state 6: The decoloring apparatus 4 is executing a decoloring job, the MFP 2 is in an active state, and both an image forming job and a decoloring job are not being currently executed FIG. 12 is a flowchart showing a message display control method performed by the MFP 2 (another image processing apparatus).

In act D1, the MFP 2 waits for a request from the decoloring apparatus 4 (No route).

When the main controller 44 of the MFP 2 receives a request from the decoloring apparatus 4 in act D1, it determines in act D2 whether or not the MFP 2 is in a power saving mode through the state management unit 50.

If the main controller 44 determines that the MFP2 is not in the power saving mode in act D2, it determines in act D4 whether the MFP 2 is executing an image forming job or a decoloring job.

Where the main controller 44 determines that the MFP 2 is not executing an image forming job or a decoloring job in act D4, it transmits information to the decoloring apparatus 4 indicating that a job can be accepted in the MFP 2 in act D5.

In FIG. 11, the main controller 107 of the decoloring apparatus 4 acquires the "acceptability of job" information sent from the MFP 2 and indicates the acceptability of a job (acts C5 and C6), and causes the window 111 to display that the MFP 2 can accept a decoloring job in act C7.

Operating state 7: The decoloring apparatus 4 is executing a decoloring job and the MFP 2 is executing an image forming job or a decoloring job In a case where the decoloring apparatus 4 is executing a decoloring job, the decoloring apparatus 4 starts communicating with the MFP 2 (act C1 to act C4 in FIG. 6).

As a result of the communication from the decoloring apparatus 4, the MFP 2 determines whether or not the MFP 2 is in a power saving mode (act D2) after receiving an inquiry from the decoloring apparatus 4 in act D1 of FIG. 12.

In the case where the MFP 2 is not in a power saving mode, the MFP 2 determines whether the MFP 2 is executing an image forming job or a decoloring job in act D4.

In a case where the MFP 2 is executing an image forming job or a decoloring job in act D4, the MFP 2 calculates an expected completion time of the image forming job or the decoloring job by the job management unit 12 in act D6.

In act D7, the MFP 2 transmits the expected completion time to the decoloring apparatus 4.

In FIG. 11, in the case where the information received from the MFP 2 indicates an expected completion time of an image forming job or a decoloring job (act C5), the decoloring apparatus 4 executes the step of act C10 in which it compares the completion time of the current decoloring job in the decoloring apparatus with the waiting time before the MFP 2 is ready to perform decoloring.

In act C10, the job management unit 102 compares (i) (decoloring job completion time of decoloring apparatus) with (ii) (waiting time of MFP).

In act C10, the job management unit 102 determines whether (i) (decoloring job completion time of decoloring apparatus) is equal to or less than (ii) (waiting time of MFP).

The main controller 107 causes the window 111 to display that the decoloring apparatus 4 can accept a decoloring job in act C11 if "time (ii) time (i)" is indicated.

If, in act C10, the job management unit 102 determines that (i) (decoloring job completion time of decoloring apparatus) is longer than (ii) (waiting time of MFP), the main controller 107 causes the window 111 to display that the MFP 2 can accept a decoloring job in act C12.

A user uses the decoloring apparatus 4 or the MFP 2 based on the information displayed on the window 111. Thus, the user waiting time is reduced.

Operating state 8: the decoloring apparatus 4 is executing a decoloring job and the MFP 2 is in a power saving mode In FIG. 11, where the decoloring apparatus 4 is executing a decoloring job and a user inputs a request for decoloring thereinto, the decoloring apparatus 4 starts communicating with the MFP 2 (act C1 to act C4).

In FIG. 12, the MFP 2 determines whether or not the MFP 2 is in a power saving mode (act D2) after receiving the inquiry from the decoloring apparatus 4 in act D1.

If the MFP 2 determines that the MFP 2 is in a power saving mode using the state management unit 50, the main controller transmits a response to the decoloring apparatus 4 in act D3.

In act D2, the main controller 44 recovers the state of the MFP 2 from a power saving state to an active state.

In FIG. 11, in a case where the information received from the MFP 2 is a request to recover from a power saving state (act C5), the main controller 107 of the decoloring apparatus 4 sends the power saving return request to the MFP 2 in act C8.

In act C9, the main controller 107 displays that the MFP 2 can accept a decoloring job on the window 111.

A user decolors an image on a sheet using the MFP 2 based on the information displayed.

With the image processing apparatus according to the second embodiment, the decoloring apparatus 4 can control the display of a message in substantially the same manner as that in the message display control method of the MFP 2 of the first embodiment.

In the second embodiment, a process in a case where the MFP 2 is in awaiting state or a stand-by state is substantially the same as a process in a case where the MFP 2 is in a power saving state.

FIGS. 1 through 12 are merely examples, and the image processing apparatuses according to the embodiments are not limited to the configurations described above. In particular, a method of achieving various functions can be selected from various methods.

In the above-described embodiments, a medium is a sheet. Special paper, such as an overhead projector (OHP) film or a label sheet, may be used as the medium.

The storage 17 may include the job management table 49. The storage 206 may include the job management table 205.

The decoloring apparatus 4 may transmit a time, for example "3:30 p.m.", indicating an expected completion time of a decoloring job to the MFP 2 instead of a remaining time.

The MFP 2 uses a toner as a decolorable recording material, but the image processing apparatus according to the embodiment may use decolorable ink as a recording material.

The MFP 2 may perform color printing. The MFP 2 may execute a fax transmission job, a fax reception job, and an e-mail transmission and reception job.

The communication units 11 and 101 may perform wireless communication. In this case, the image processing apparatus according to the embodiment is provided with an antenna instead of the signal line 3.

In a case where ink is used, the image processing apparatus according to the embodiment uses an ink jet head printer instead of the printing unit 15. In this case, a decoloring unit 10 of the MFP 2 which does not have a fixing function is used.

The capabilities of the image processing apparatus according to the embodiment is not compromised even in a case of an implementation in which these changes are made.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. An image processing apparatus for decoloring a decolorable toner image formed on one or more sheets, comprising:

an image processing unit comprising a controller and an image heating section, wherein the image heating section is selectively operable at a toner fixing temperature and an image decoloring temperature that is higher than the toner fixing temperature;

a communication interface configured to communicate with an external decoloring device; and a user input section, wherein the controller, upon receiving a request to decolor one or more sheets that is made through the user input section, determines which of the image heating section and the external decoloring device will be the first available to decolor the one or more sheets.

2. The image processing apparatus of claim 1, wherein the controller determines that the external decoloring device will be the first available to perform the decoloring, if the image heating portion is being operated at the toner fixing temperature.

3. The image processing apparatus of claim 2, wherein the controller transmits an inquiry about whether or not the external decoloring device is capable of performing the decoloring, if the image heating section is operating at the toner fixing temperature.

4. The image processing apparatus of claim 3, wherein the controller transmits to the external decoloring device a request to recover from a power saving state, if the controller receives a response from the external decoloring device that it is able to perform the decoloring.

5. The image processing apparatus of claim 4, further comprising:

a display, wherein the controller controls the display to display information indicating that the external decoloring device is available to perform the decoloring after transmitting the request to the external decoloring device.

6. A method of performing an image processing job in an image processing apparatus having an image processing unit comprising a heating section for performing a heating process on a sheet, and a communication interface for communicating with an external decoloring device that is separately provided from the image processing apparatus, said method comprising:

receiving a user request to decolor one or more sheets through a user input section of one of the image processing apparatus; and responsive to the user request, determining which of the first heating section and the external decoloring device will be the first available to perform the decoloring.

7. The method of claim 6, wherein responsive to the user request, determining, by a controller, that the external decoloring device will be the first available to perform the decoloring, if the image heating portion is being operated at the toner fixing temperature.

8. The method of claim 7, further comprising:

transmitting an inquiry about whether or not the external decoloring device is capable of performing the decoloring, if the image heating section is operating at the toner fixing temperature.

9. The method of claim 8, further comprising:

upon receiving a response from the external decoloring device that it is able to perform the decoloring, transmitting to the external decoloring device a request to recover from a power saving state.

10. The method of claim 9, further comprising:

displaying that the external decoloring device is available to perform the decoloring after transmitting the request to the external decoloring device.

* * * * *